United States Patent [19]

Yoshimura et al.

[11] Patent Number: 4,838,810

[45] Date of Patent: Jun. 13, 1989

[54] COUPLING ENGAGEMENT MECHANISM FOR ELECTRIC CONNECTOR

[75] Inventors: Yoshikazu Yoshimura; Kihachiro Koike, both of Tokyo, Japan

[73] Assignees: Hirose Electric Co, Ltd.; NEC Corporation, both of Tokyo, Japan

[21] Appl. No.: 186,482

[22] Filed: Apr. 26, 1988

[30] Foreign Application Priority Data

Apr. 30, 1987 [JP] Japan ..... 62-65985

[51] Int. Cl.[4] ..... H01R 13/627; H01R 13/648

[52] U.S. Cl. ..... 439/358; 439/350; 439/607

[58] Field of Search ..... 439/292, 293, 345, 347, 439/350, 352, 353, 355, 358, 362, 372, 607–610, 786

[56] References Cited

U.S. PATENT DOCUMENTS 3,566,336 2/1971 Johnson et al. ..... 439/353

4,699,438 10/1987 Kikuta ..... 439/607 X

FOREIGN PATENT DOCUMENTS 53-47580 4/1978 Japan .

*Primary Examiner*—Eugene F. Desmond

*Assistant Examiner*—Stephen A. Zagrobelny

*Attorney, Agent, or Firm*—Fleit, Jacobson, Cohn & Price

[57] ABSTRACT

A coupling engagement mechanism for an electric connector comprises engagement fixtures and an insulating housing element which includes engagement fixture receiving portions for accommodating the engagement fixtures. Each of the engagement fixtures is unitarily formed of a springy metal plate. An engagement portion which engages an abutting portion of a mating connector is formed at one end of a body of each engagement fixture. A manipulation portion is formed at the other end of the body. Elastic pieces whose upper ends are continuous to the body and which extend downwards are formed on both right and left sides of the body. Each of the elastic pieces is formed with, at least, a first coming-off-preventive bend and a second coming-off-preventive bend at a predetermined interval in a direction of the extension. Each engagement fixture receiving portion of the insulating housing element is formed with a first protuberance and a second protuberance at an interval in the extending direction. When the engagement fixture is inserted into the engagement fixture receiving portion, the first coming-off-preventive bend and the second coming-off-preventive bend are held between the first protuberance and the second protuberance, whereby the engagement fixture is fitted and fixed in the insulating housing element.

8 Claims, 5 Drawing Sheets

COUPLING ENGAGEMENT MECHANISM FOR ELECTRIC CONNECTOR

BACKGROUND OF THE INVENTION

1. Field of the Invention

This invention relates to a coupling engagement mechanism for an electric connection.

2. Description of the Prior Art

There have heretofore been various forms of mechanisms for holding the coupled state of connectors in engagement. A mechanism of the no-shaft type in which no part is supported by a shaft or the like has been proposed as a form of easy engaging and disengaging operations which is assembled merely by fitting engagement members into connector cases. An example of this mechanism is disclosed in the official gazette of Japanese Utility Model Registration Application Publication No. 47580/1978, and the schematic construction thereof is as shown in FIGS. 6 and 7 of the accompanying drawings. FIG. 6 is a sectional front view showing the state in which engagement members are installed in a connecter cover, while FIG. 7 is a sectional view taken along line C—C in FIG. 6.

As illustrated in FIGS. 6 and 7, the no-shaft type connector coupling engagement mechanism in the prior art comprises the engagement members 1, each of which is formed with a hooked engaging portion 2 at one end thereof and with a depressing portion 3 at the other end thereof. Elastic pieces 4, 4' made of a flexible material are provided on both the sides of the engagement member 1. These elastic pieces 4, 4' are unitary with the engagement member 1 as shown in the figures, and each of them is formed so as to be weaker than the engagement member 1 proper, namely, to have a smaller width, thereby to be endowed with an elasticity. On the other hand, the side of the engagement member 1 proper is formed with a reinforcement strip 5, thereby to be rendered stiffer than the parts of the elastic pieces 4, 4'. The connector cover consists of two split cases 6, 6', each of which is formed with groove portions 7, 7' for snugly inserting the distal end parts of the elastic pieces 4, 4'. When the respective engagement members 1 are set up in such cases 6, 6' by snugly inserting the distal ends of the elastic pieces 4, 4' of these engagement members 1 into the groove portions 7, 7', the engaging portions 2 are united with abutting pieces 8, 8' formed on the other connector, and the depressing portions 3 are mounted facing the windows 9 of the cases 6, 6'. Now, the depressing portions 3 are depressed into the windows 9 in the state of FIG. 6. Then, since the distal end parts of the elastic pieces 4, 4' are snugly inserted in the groove portions 7, 7', these elastic pieces flex between the snug insertion parts and connective portions 10, 10'. Accordingly, the engaging portions 2 move in direction away from the depressing portions 3 and come off the abutting pieces 8, 8', whereby the coupling between the connectors can be released.

The prior-art coupling engagement mechanism for the electric connector as stated above has had the following problems:

(1) In fixing the engagement members 1 to the cases 6, 6', merely the elastic pieces 4, 4' on both the sides of the engagement members 1 are snugly inserted into the groove portion 7, 7' of the cases 6, 6'. Therefore, when the engagement members 1 are repeatedly operated, there arises the problem that the groove portions 7, 7' sag to fix the engagement members 1 unstably and to loosen them more in vertical and lateral directions, until the engagement members 1 finally drop away from the cases.

(2) At least the upper half of the connector cover must be formed into the two split cases. The cases become complicated in structure and are very difficult of molding, to incur a high cost.

(3) The depressing portion 3 of the engagement member 1 is formed by the unitary working of a metal sheet material. Therefore, in case of depressing this portion with a finger, the touch of the finger is inferior, and the tip of the finger sometimes slips. Moreover, the appearance of the depressing portion is poor.

An object of the present invention is to provide a coupling engagement mechanism for an electric connector which can solve the problems of the prior art as mentioned above.

SUMMARY OF THE INVENTION

According to this invention, there is provided a coupling engagement mechanism for an electric connector having engagement fixtures and an insulating housing element which includes engagement fixture receiving portions for accommodating the engagement fixtures, characterized in that each of the engagement fixtures is unitarily formed of a springy metal plate, that an engagement portion which engages an abutting portion of a mating connector is formed at one end of a body of each engagement fixture, while a manipulation portion is formed at the other end, that elastic pieces whose upper ends are continuous to the body and which extend downwards are formed on both right and left sides of the body, and that each of the elastic pieces is formed with, at least, a first coming-off-preventive bend and a second coming-off-preventive bend at a predetermined interval in a direction of the extension, while each engagement fixture receiving portion of the insulating housing element is formed with a first protuberance and a second protuberance at an interval in the extending direction, so that when the engagement fixture is inserted into the engagement fixture receiving portion, the first coming-off-preventive bend and the second coming-off-preventive bend are held between the first protuberance and the second protuberance, whereby the engagement fixture is fitted and fixed in the insulating housing element.

This invention will now be described in further detail with regard to preferred embodiment as illustrated in the accompanying drawings.

DESCRIPTION OF THE PREFERRED EMBODIMENT

Figure 1:
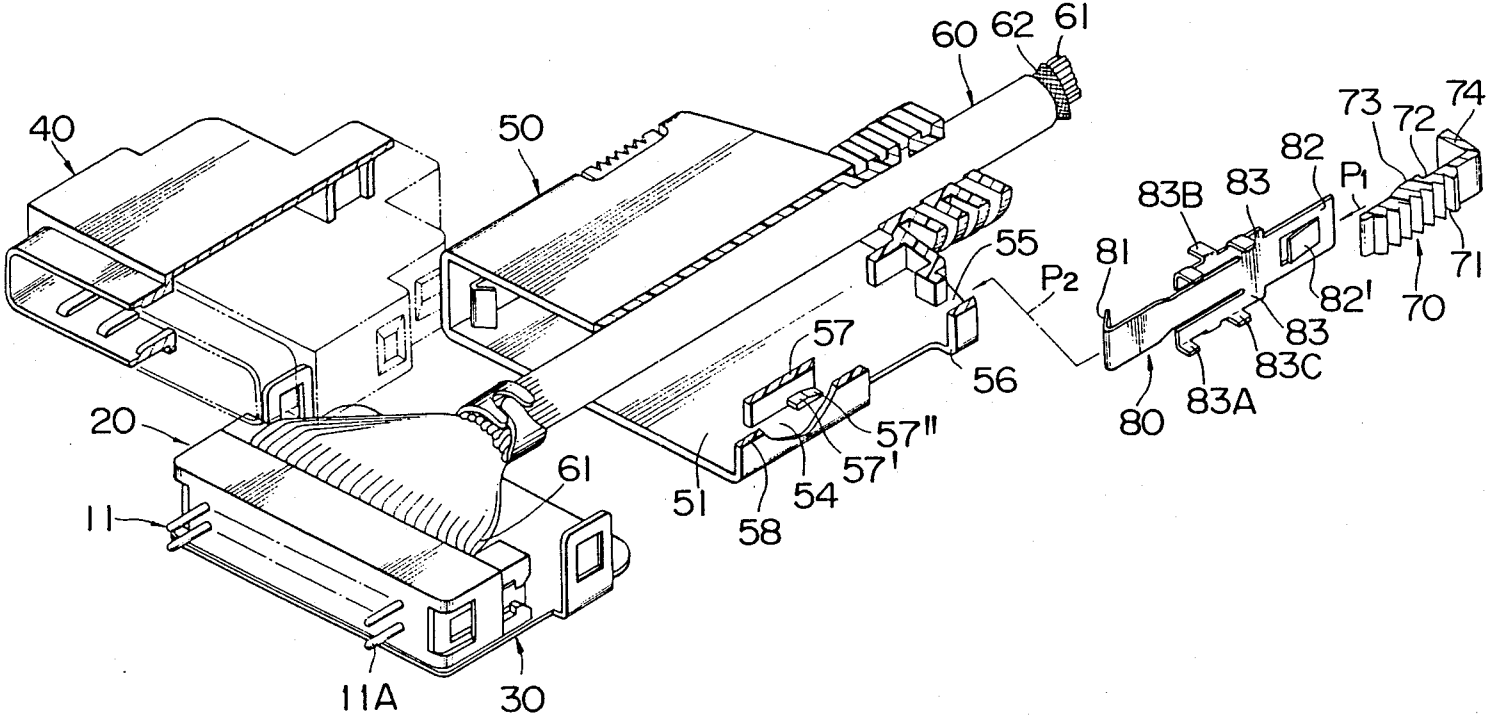
FIG. 1 is an exploded perspective view, partly broken away, showing an electric connector to which a coupling engagement mechanism as an embodiment of the present device is applied.

Referring now to FIG. 1, there is shown an electric connector according to an embodiment of this invention. The electric connector is of a shielded type and comprises principally contact pins 11, an insulating housing 20, a shield lid member 30, a shield hood member 40, an insulating hood 50, buttons 70, and engagement fixtures 80.

Figure 2A:
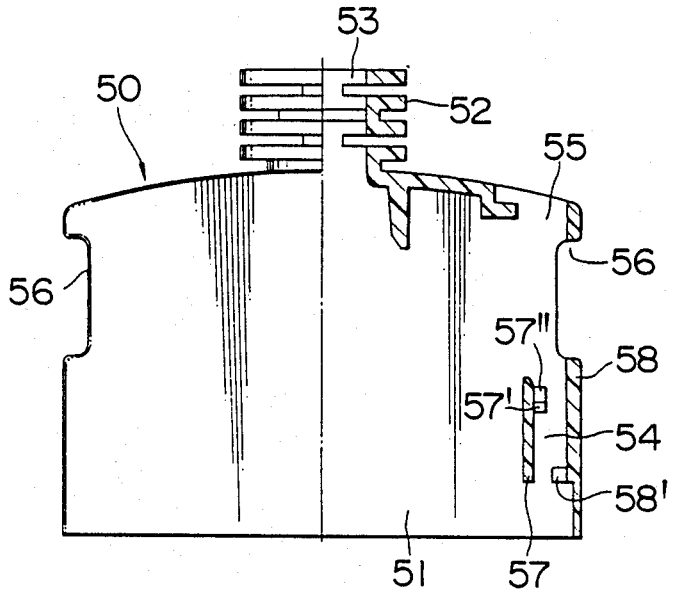
FIG. 2A is a half-sectional front view of the insulating hood of the electric connector of FIG. 1.
Figure 2B:
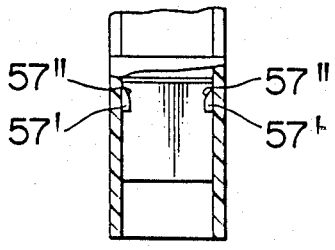
FIG. 2B is a partial vertical sectional view of the side part of the insulating hood of FIG. 2A.

As clearly shown in FIGS. 2A and 2B, the insulating hood 50 is unitarily molded of a plastics material, in a manner to include a hollow 51 which accommodates the shield lid member 30 and shield hood member 40 unitarily assembled as will be stated later, and a fin 52 which has a through hole 53 for causing a cable 60 to penetrate it, the cable having wires 61 and a shield layer 62. On both the sides of the hollow 51, there are provided engagement fixtures receiving portions 54 for accommodating the engagement fixtures 80, and button receiving portions 55 for accommodating the buttons 70. The button receiving portion 55 is formed with a recess 56 for exposing the antiskid corrugation 71 of the button 70. On the other hand, the engagement fixture receiving portion 54 is defined between an inner side wall 57 and an outer side wall 58, and a pair of engagement projections 57' exerting a function to-be-stated-later on the upper ceiling and bottom of the engagement fixture receiving portion side are provided on the inner side wall 57, while a pair of stopper lugs 58' exerting a function to-be-stated-later on the ceiling and bottom of the engagement fixture receiving portion side substantially in the middle of the outer side wall 58 are provided on the inner side of the outer side wall 58. As clearly shown in FIG. 2B, the engagement projection 57' is provided with a tapered portion 57''.

Figure 3A:
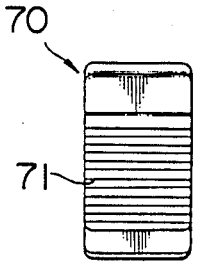
FIG. 3A is a front view of the button of the electric connector of FIG. 1.
Figure 3B:
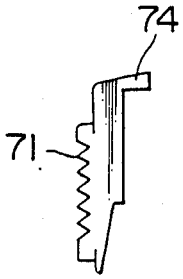
FIG. 3B is a side view of the button of FIG. 3A.
Figure 3C:
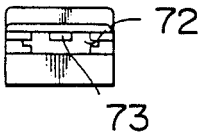
FIG. 3C is a bottom view of the bottom of FIG. 3A.

As clearly shown in FIGS. 3A, 3B and 3C, the button 70 is molded of a plastics material of the same property as that of the plastics for forming the insulating hood 50, and it is provided with an antiskid corrugation 71 which protrudes from the recess 56 of the insulating hood 50 and which serves to depress the hook 81 of an engagement fixture 80 with a finger, and a fixation groove 72 which serves to receive and fix the button mounting portion 82 of the engagement fixture 80 as a manipulating portion on the opposite side to the antiskid corrugation 71. Further, 2 step portion 73 for engaging a tongue 82' formed on the button mounting portion 82 of the engagement fixture is provided substantially in the middle of the fixation groove 72. Still further, an L-shaped stopper portion 74 is provided above the antiskid corrugation 71.

Figure 4A:
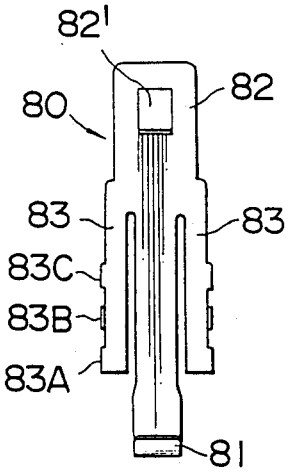
FIG. 4A is a front view of the engagement fixture of the electric connector of FIG. 1.
Figure 4B:
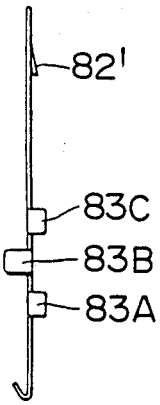
FIG. 4B is a side view of the engagement fixture of FIG. 4A.

As clearly shown in FIGS. 4A and 4B, the engagement fixture 80 is formed of a springy metal material by punching and bending, in such a manner that the hooked engagement portion 81 is provided at the extreme end of this fixture, while the button mounting portion 82 having the tongue 82 is formed on the other end side. Springy or elastic portions 83 are provided on both sides of the engagement fixture 80 substantially in the middle thereof. As clearly shown in FIG. 4(B), each elastic portions 83 is formed with a first coming-of-preventive bend 83A which, as will be described later, engages the stopper lug 58' thereby to prevent the engagement fixture 80 from coming off downwards when the engagement fixture is accommodated in the engagement fixture receiving portion 54 of the insulating hood 50, a second coming-off-preventive bend 83B which engages the engagement projection 57' above the first coming-off-preventive bend 83A thereby to prevent the engagement fixture 80 from coming off upwards when the engagement fixture is accommodated in the engagement fixture receiving portion 54, and a stabilizer bend 83C which lies above the second coming-off-preventive bend 83B and which operates to locate the engagement fixture substantially centrally of the engagement fixture receiving portion 54 and to stabilize the elastic portion 83.

Next, there will be described a method of assembling the coupling engagement mechanism for the electric connector of such construction.

(1) First, the button mounting portion 82 of an engagement fixture 80 is inserted into the fixation groove 72 of a button 70 as indicated by an arrow $P_1$ in FIG. 1. Then, the tongue 82' of the engagement fixture 80 runs onto a step portion 73 provided in the fixation groove 72. Upon further insertion, the tongue 82' is restored by springiness, and the tongue 82' and the step portion 73 are brought into engagement to fix the engagement fixture 80 and the button 70.

Figure 5:
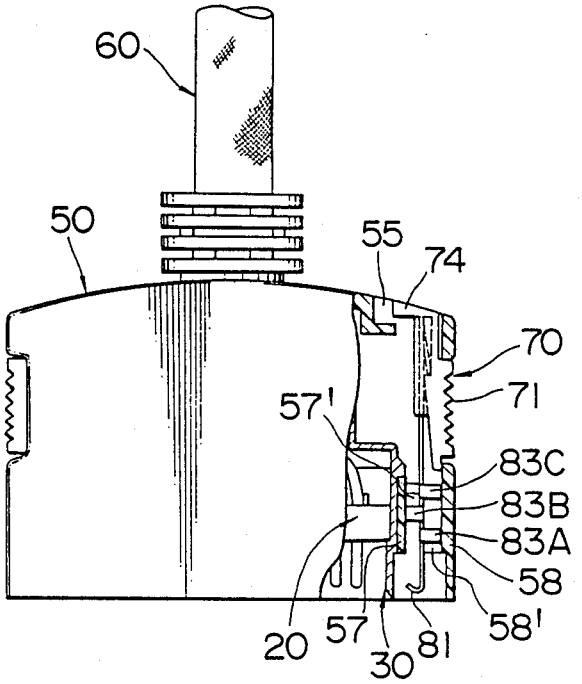
FIG. 5 is a fragmentary front view showing the wire-jointed and assembled state of the electric connector of FIG. 1.
Figure 6:
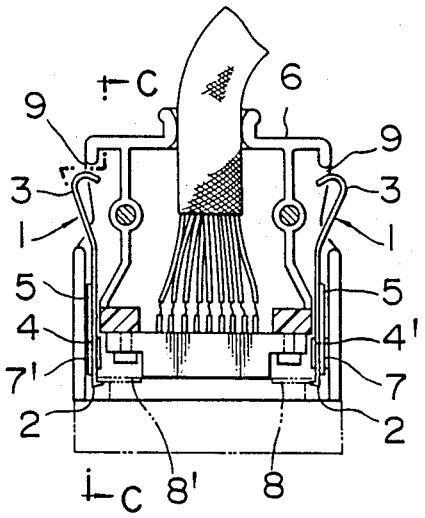
FIG. 6 PRIOR ART
FIG. 6 is a sectional front view showing the state in which engagement members are set up in a connector cover in an example of a prior-art coupling engagement mechanism for a connector.
Figure 7:
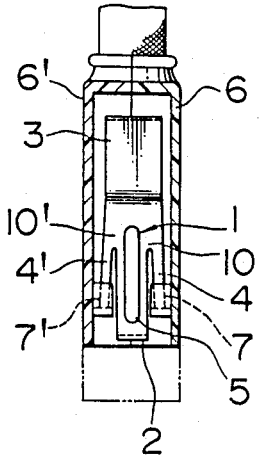
FIG. 7 PRIOR ART
FIG. 7 is a sectional view taken along line C—C in FIG. 6.

(2) The engagement fixture 80 thus set up is gradually inserted from a button receiving portion 55 on the corresponding upper side of an insulating hood 50. Then, the first coming-off-preventive bend 83A with which the elastic portion 83 of the engagement fixture 80 is provided passes the projection 57'. Further, the second coming-off-preventive bend 83B subsequently gets on the engagement projection 57' and passes it in a similar manner. Besides, the first coming-off-preventive bend 83A abuts against the stopper lug 58' of the engagement fixture receiving portion 54 and comes in engagement therewith. A stabilizer bend 83C abuts against the inner surface of an outer side wall 58, thereby functioning to stabilize the latch action of the engagement fixture 80 more. On this occasion, the button 70 passes the button receiving portion 55 while bending the engagement fixture 80 inwards, and the antiskid corrugation 71 of the button 70 is secured so as to project from the recess 56 of the insulating hood 50 as shown in FIG. 5.

In this way, the insertion mounting of the engagement fixture 80 in the insulating hood 50 is completed.

Since the coupling engagement mechanism for an electric connector according to the present device is constructed as stated above, the following effects are attained:

(1) Each engagement fixture is reliably secured in the engagement fixture receiving portion of an insulating hood, and even when the engagement fixture is repeatedly operated, it is not feared to loosen in vertical and lateral directions, and it does not drop out of the insulating hood.

(2) Since the insulating hood need not be split and may be of simple construction, it is easy of molding and reduction in cost becomes possible.

(3) Since a button made of the same plastics as that of the material of the insulating hood can be readily attached to the engagement fixture, an antiskid portion for a finger tip can be easily formed. Morever, the button can be put into an exterior configuration matching with the insulating hood and can be endowed with a good appearance.

What is claimed is:

1. A coupling engagement mechanism for an electric connector having engagement fixtures, and an insulating housing element which includes engagement fixture receiving portions for accommodating the engagement fixtures, said coupling engagement mechanism characterized in that said each engagement fixture is unitarily formed of a springy metal plate, that an engagement portion which engages an abutting portion of a mating connector is formed at one end of said each engagement fixture, while a manipulation portion is formed at the other end, that elastic portions having one of their ends continuous with an intermediate portion of said engagement fixture and extending on both right and left sides of said engagement fixture toward the engagement portion, that said each elastic portion is formed with, at least, a first coming-off-preventive bend and a second coming-off-preventive bend at a predetermined interval in the direction of the extension, while said each engagement fixture receiving portion of said insulating housing element is formed with a first protuberance and a second protuberance at an interval in the extending direction, said engagement fixture being inserted into said engagement fixture receiving portion, with said first coming-off-preventive bend and said second coming-off-preventive bend held between said first protuberance and said second protuberance, whereby said engagement fixture is fitted and fixed in said insulating housing element.

2. A coupling engagement mechanism as claimed in claim 1, wherein an upper part of said first protuberance is formed with a tapered portion, so that said second coming-off-preventive bend may easily get over said first protuberance.

3. A coupling engagement mechanism as claimed in claim 1, wherein said engagement fixture receiving portion is formed between an inner side wall and an outer side wall of said insulating housing element; said first protuberance is provided in proximity to said inner side wall, while said second protuberance is provided in proximity to an inner surface of said outer side wall; said first coming-off-preventive bend and said second coming-off-preventive bend are formed by being bent substantially orthogonally in opposite directions with respect to a plane of said elastic portion; and said first coming-off-preventive bend abuts on a lower surface of said first protuberance, while said second coming-off-preventive bend abuts on an upper surface of said second protuberance.

4. A coupling engagement mechanism as claimed in claim 3, wherein said elastic portion is formed with a stabilizer bend which is spaced above from said first coming-off-preventive bend in said extending direction, and a lower end surface of said stabilizer bend abuts on said inner surface of said outer side wall.

5. A coupling engagement mechanism as claimed in claim 1, wherein said manipulation portion of said engagement fixture is furnished with a button which is formed of an insulating material identical in property to a material forming said insulating housing element.

6. A coupling engagement mechanism as claimed in claim 5, wherein said manipulation portion of said engagement fixture is formed with a tongue, while said button is formed with a fixation groove, and said tongue is inserted into said fixation groove, whereby said button is mounted on said manipulation portion.

7. A coupling engagement mechanism as claimed in claim 5, wherein an outer surface of said button is formed with an antiskid portion.

8. A coupling engagement mechanism as claimed in claim 7, wherein said insulating housing element is formed with recesses at side parts thereof near said engagement fixture receiving portions, and said antiskid portions of said buttons are exposed from said recesses.

* * * * *